US008864912B2

(12) United States Patent
Jakob et al.

(10) Patent No.: US 8,864,912 B2
(45) Date of Patent: Oct. 21, 2014

(54) METHOD AND DEVICE FOR INTERNALLY CLEANING CANS HAVING CORRESPONDING OPENINGS

(75) Inventors: Timo Jakob, Framersheim (DE); Steffen Kappel, Bad Kreuznach (DE); Thomas Stolte, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/260,991

(22) PCT Filed: May 7, 2010

(86) PCT No.: PCT/EP2010/002804

§ 371 (c)(1),
(2), (4) Date: Sep. 29, 2011

(87) PCT Pub. No.: WO2010/130373

PCT Pub. Date: Nov. 18, 2010

(65) Prior Publication Data

US 2012/0037190 A1 Feb. 16, 2012

(30) Foreign Application Priority Data

May 12, 2009 (DE) ..... 10 2009 020 957

(51) Int. Cl.

| | |
|---|---|
| ***B08B 9/093*** | (2006.01) |
| ***B08B 9/00*** | (2006.01) |
| ***B08B 9/42*** | (2006.01) |
| ***B08B 9/30*** | (2006.01) |
| ***B08B 5/02*** | (2006.01) |

(52) U.S. Cl.

CPC ... *B08B 9/30* (2013.01); *B08B 9/00* (2013.01); *B08B 9/42* (2013.01); *B08B 5/02* (2013.01)

USPC ..... 134/22.18; 134/15; 134/18; 134/21; 134/22.1; 134/22.12; 134/23; 134/24; 134/25.4; 134/26; 134/30; 134/32; 134/36; 134/37; 134/42; 134/43; 134/62; 134/66; 134/68; 134/166 R; 15/302; 15/304; 15/306.1; 15/309.2

(58) Field of Classification Search

USPC ..... 134/15, 18, 21, 22.1, 22.12, 22.18, 23, 134/24, 25.4, 26, 30, 32, 36, 37, 42, 43, 62, 134/66, 68, 166 R; 15/302, 304, 306.1, 15/309.2

See application file for complete search history.

(56) References Cited

U.S. PATENT DOCUMENTS

| | | | |
|---|---|---|---|
| 3,190,298 | A | 6/1965 | Faller et al. |
| 3,291,143 | A | 12/1966 | Huddle |

(Continued)

FOREIGN PATENT DOCUMENTS

| | | |
|---|---|---|
| DE | 2817825 | 10/1979 |
| DE | 4229580 | 3/1994 |

(Continued)

*Primary Examiner* — Bibi Carrillo

(74) *Attorney, Agent, or Firm* — Occhiuti & Rohlicek LLP

(57) ABSTRACT

Internal cleaning of inverted cans includes engaging a can's cylindrical wall with a wall-conforming vacuum or adhesive gripper, causing a spraying unit to travel axially in and out of the can's opening while the can is inverted on a circular conveyor, and using a supporting arm or bottom stop to subject the can to a counterforce against a flushing force from sprayed cleaning medium. This prevents the can from being pressed out of a receptacle in which it sits during cleaning.

9 Claims, 4 Drawing Sheets

(56) References Cited

U.S. PATENT DOCUMENTS

| | | | | |
|---|---|---|---|---|
| 3,941,237 | A | 3/1976 | Macgregor et al. | |
| 4,092,991 | A | 6/1978 | Rohrs | |
| 4,104,081 | A * | 8/1978 | Totten | 134/23 |
| 5,316,255 | A * | 5/1994 | Marcusen | 248/362 |
| 5,409,545 | A * | 4/1995 | Levey et al. | 134/22.18 |
| 5,425,385 | A * | 6/1995 | Kuta et al. | 134/48 |
| 5,441,063 | A * | 8/1995 | Fernandez et al. | 134/142 |
| 5,974,689 | A * | 11/1999 | Ferrell et al. | 34/340 |
| 6,544,473 | B1 * | 4/2003 | Shintaku et al. | 422/26 |
| 2007/0240784 | A1 * | 10/2007 | Wu et al. | 141/89 |
| 2010/0037925 | A1 * | 2/2010 | Kappel et al. | 134/166 R |
| 2010/0071724 | A1 | 3/2010 | Baumgartner et al. | |

FOREIGN PATENT DOCUMENTS

| | | |
|---|---|---|
| DE | 29609831 | 8/1997 |
| DE | 102006044904 | 3/2008 |
| EP | 0588134 | 3/1994 |
| EP | 0727367 | 8/1996 |
| GB | 2426696 | 12/2006 |
| JP | 2002096807 | 4/2002 |

* cited by examiner

METHOD AND DEVICE FOR INTERNALLY CLEANING CANS HAVING CORRESPONDING OPENINGS

CROSS-REFERENCE TO RELATED APPLICATIONS

This application is the National Stage of International Application No. PCT/EP2010/002804, filed on May 7, 2010, which claims the benefit of the priority date of German Patent Application No. 10 2009 020 957.3, filed on May 12, 2009. The contents of both applications are hereby incorporated by reference in their entirety.

FIELD OF DISCLOSURE

The invention relates to a method for the handling, in particular the internal cleaning, of cans with openings that are normally at the top of the can at the opposite end from a base of the can and that are normally sealed by means of a lid after the can is filled with a fluid.

BACKGROUND

The internal cleaning of cans calls for a great deal of design-related and experimental expenditure, as exemplified by JP 2002096807 A. As is the case here, the internal cleaning process is performed by spraying-on a cleaning fluid within an aseptic atmosphere.

In addition, DE 296 09 831 U1 is concerned with the insertion, in portions, of fluids into cans. The cans are moved in a circle using a rotor, whereby the cans stand upright on their base. How and whether the cans are subjected to prior internal cleaning remains unclear.

Furthermore, the overhead handling of bottles is basically known about, as is described in DE 42 29 580 A1. In this case, the bottles are rinsed, that is to say, the inside of the bottles is washed out with a cleaning fluid. Special bottle grippers are used for this purpose, and the mouth of the bottle is treated with a sterilization medium.

DE 10 2006 044 904 A1 operates in a similar manner, whereby a spraying unit enters the inside of the bottle, preferably up as far as the base. Special devices are also required in this case to hold the bottle in the desired overhead position.

Such procedures do not have any application for the cleaning of the inside of cans with an opening. This is because, in particular, drink-cans are, these days, predominantly made from very thin steel plate in order to keep the costs and the use of materials down to the lowest possible level. As a consequence, the basic problem that arises with mechanical manipulation of cans is that their surfaces are susceptible to damage and that, in the worst case, they can be crushed. As a result, their subsequent sale becomes impossible.

For this reason, in normal practice, the process of cleaning the inside of cans with openings usually involves the use of linear gravity rinsers. These devices generally have a spiral guide rail for the cans. The cans are then conveyed individually by the effect of gravity along the guide rail and are subjected to a 180° turn so that, at the end of the guide rail conveying process, they stand head downwards in the overhead position.

The cans in the overhead position are then treated with a cleaning medium. The cleaning medium is dispensed by a fixed nozzle assembly onto the cans or into their interior. The cans are treated from the bottom upwards using this nozzle assembly, which has nozzles set at intervals extending lengthwise from the respective opening.

As a result of the spacing of the nozzles from the opening, the jet of the cleaning medium is constantly interrupted and is, for example, reflected on the walls of the cans. Due to this, a relatively large amount of cleaning medium is needed, much of which does not achieve any targeted internal cleaning and is therefore wasted. This results in increased costs that have to be taken into account.

SUMMARY

The invention is based upon the technical problem of further developing a process for the inner cleaning of cans with openings in such a way that the cleaning effect will be enhanced and at the same time the amount of the requisite cleaning medium will be reduced.

According to the invention, a process is proposed for resolving this technical problem, characterized in that the can is held in place by adhesion, by a vacuum, and/or by means of a preferably flexible clamping gripper that grips onto the can body or onto the can walls.

It is thereby ensured that the can is gently held in place during the whole of its conveying process and in particular, while being cleaned inside. The can be held gently in place by vacuum or negative pressure or by adhesion and/or on the other hand due to the fact that one or several clamping grippers engage with the can on its body or on its walls and hold the can in place.

In the first of the aforementioned cases, the generation of the negative pressure or vacuum is seen as being basically a suction holder or generally an adhesive holder, which holds the can in place around its circumference or the can body by a vacuum. In this way it is ensured that the can is subjected to virtually no mechanical pressurization and as a result, is not damaged.

A comparable damage-free fixing of the can relies on one or several flexible clamping grippers. Each clamping gripper is adapted to the peripheral contour of the can or the can body. Generally the clamping gripper is curve-shaped. Usually, the radius for the curve or curve-shaped clamping gripper and that of the can body are matched to each other. In order to achieve the adhesion of the can to the preferably flexible clamping gripper, the clamping gripper can be made from a material that has higher adhesive properties than, for example metal, i.e. from an elasticized plastic.

It is conceivable at this point to install an additional way to increase adhesion between the clamping gripper and the can. One way to do this is to use a film of liquid, for example a water and/or oil based liquid, on an inner side of the gripper, namely the side that faces towards the can. A liquid feed line to the respective clamping gripper might provide an appropriate way of feeding the liquid. In addition, the clamping gripper is equipped in this case with one or several internal openings towards the can body, through which the liquid is discharged. In this case, the can is fixed by adhesion, while at the same time being held in place by the clamping gripper.

Alternatively, or at the same time, the clamping gripper can also function in the form of the suction holder that has already been described and then provide the negative pressure or vacuum that is used to ensure that the can is securely held in place during the described process. This applies at least provided that no stabilizing liquid is inserted into the can that stabilizes its walls or the can body.

This process has not, so far, been considered to be possible in the art because the wall of the can or the can body in its empty and unfilled condition is exceptionally fragile and susceptible to damage, which may preclude its subsequent filling and sale. In any case, according to the invention, the can is exposed to virtually no mechanical pressurization on its sides and will not be damaged. This lack of mechanical pressure on its sides occurs both during the internal cleaning process, during the turning process, and/or at the final filling process. That means that the can undergoes an exceptionally gentle handling process.

According to the invention, the cans are cleaned by a spraying unit that is fixed in terms of its height, but which is not axially maneuverable, for discharging the cleaning medium into the cans opening.

However, according to the previously mentioned type of design, an axially maneuvered or maneuverable spraying unit for the discharging of the cleaning medium into the opening for the (overhead) internal cleaning travels in and out of the can. The cans are generally treated with the cleaning medium along a conveyor, and in particular a circular conveyor, in the described overhead position. It has, in addition, proved to be advantageous for the can to be guided into the aforesaid overhead position prior to its being cleaned or internally cleaned.

After its internal cleaning, the can can be further conveyed in the overhead position. But by way of an alternative, or in addition, it is also conceivable that the can, after its internal cleaning, is turned from the overhead position by approximately 180° into its filling position, because, for the most part, the filling of the cans is performed in conjunction with the described internal cleaning process and the opening is then sealed. In the course of this, the lid is applied to the opening and joined to the can walls. That is to say, the can in question is usually designed in a hollow cylindrical shape and has a circular opening, which is closed-up after the cleaning or after being filled with the desired liquid using a lid.

The can is typically a rotationally symmetric and essentially cylindrical drink-can, although in the context of the invention other cans can naturally also be handled as described. For the most part however, the process is used for drink-cans, which have exceptionally low wall thickness and are, as a result, particularly fragile and liable to be damaged when being mechanically handled.

In addition, it has turned out to be advantageous if the can in question is subjected to a counterforce to counter the flushing force during the cleaning process. In this case, the invention starts from the knowledge that the axially-moving spraying device, which travels in and out of the opening for the (overhead) internal cleaning of the can in question, applies the described flushing force to the base of the can. The danger then arises in connection with the suction holder or generally adhesive holder, which usually holds the can around its outer circumference, that the can may be released from the suction holder as a result of this built-up flushing force. The counterforce, which in the main is provided by a bottom stop that acts as the overlapping supporting arm for the respective can, operates to counteract this.

This bottom stop or the supporting arm that is formed in this way ensures that the can's base is subjected to an offsetting counterforce in relation to the flushing force and, as a result, the danger of the can being, for example, released by the suction holder does not arise.

The cleaning medium is usually a cleaning fluid and/or a cleaning gas. In this case, the operation is for the most part performed both with a cleaning fluid and a cleaning gas. The can is then flushed out from the inside outwards with the respective cleaning fluid. The axially-moving spraying unit then travels preferably, but not essentially, into the respective can. This type of axial movement of the spraying unit relates in this respect to the rotationally symmetrical axis of the can or of its longitudinal axis. After the flushing process with the cleaning fluid, the axially moved spraying unit travels outwards once again from the can.

As a result of the overhead position that has been assumed during the cleaning of the can, any cleaning fluid can drop out of the opening assisted by gravity. As further support for this process, it has proven to be worthwhile if, after flushing with the cleaning fluid, the inside of the cans are flushed-out with a gaseous cleaning medium and, in particular, a pressurized sterilizing medium. In this way any left-over cleaning fluid in the interior is expelled from the can.

Compared to the current state of the art, a clearly improved cleaning result has been observed in the way that the axially and preferably intermittently moved spraying unit travels in and out of the opening for the (overhead) internal cleaning of the can. This is because, with the use of the spraying unit or by means of the nozzle that is fitted at the head, the cleaning medium or cleaning fluid that is applied is aimed directly towards the base of the can. The cleaning fluid or the cleaning medium flows from there, in a radial direction, up to the walls of the can and then, aided by gravity, along the walls of the can to the opening of the can. In this it should be understood that the respective spraying unit usually travels centrally in and out of the can in order to enable a uniform internal cleaning operation to be performed.

It can thus be ensured that the (overhead) internal cleaning along the circular conveyor is performed and that in each case, a separate and axially-moving spraying unit is inserted for every can that is to be cleaned. That means that during the (overhead) internal cleaning, the can and the spraying unit move synchronously with each other along the circular track provided by the circular conveyor. In the course of this joint circular rotation, it is only the distance between the spraying unit or its nozzle on the top and the can or its opening that alters in relation to the base of the can.

It should be thereby understood that the extent of the insertion of the spraying unit into the can, as well as the duration that it remains inside the can, is able also to be varied by a corresponding control of the curved movement of the spraying unit. That is to say, the spraying unit can fully perform an overall fully-controlled movement with respect to the corresponding fixed can and also during the joint circular rotation along the circular conveyor. Obviously, moving the can and the respectively related spraying unit along a linear conveyor is also conceivable and is within the scope of the invention. But in both cases, it has to be arranged that the can that is to be cleaned and the spraying unit move along synchronously in the course of the cleaning process. A change of the axial distance of the spraying unit in relation to the can takes place, while the spraying unit actually travels in and out of the can or of its opening and does so in an axial direction.

Various procedures are conceivable in order to bring the can into the requisite overhead position for internal cleaning from the filling position that has been assumed with the opening upwards during the carrying-out of the internal cleaning or after the production process. In this way the cans are turned from the filling position into the overhead position during the cleaning process or at the inlet side of a device for the internal cleaning. But it is also possible to introduce the cans into the desired overhead position prior to reaching the relevant device for the (overhead) internal cleaning.

It is conceivable here to operate with for example an in-feed star or, in general, with an in-feed conveyor, which automatically turns the cans from the filing position into the overhead position. The same thing may take place from the inlet side. That is to say, the cans are able to be turned after the described inner filling process from the overhead position that has been in so doing adopted into the filling position on the exit side of the device for the (overhead) internal cleaning that is installed at this point. But it is also possible to have a special and separate turning device after passing the device for the (overhead) internal cleaning at the exit or in the exit of the cans. Obviously installing such a separate turning device in the or at the entry to the relative device for the (overhead) internal cleaning is also within the scope of the invention.

Any conceivable cleaning fluid can be used as the cleaning medium. But it is also possible to flush the cans with ionized air or another gaseous cleaning medium. Thus any conceivable rinsing processes with water and/or disinfectant and/or air as the cleaning medium are encompassed by the invention. The invention crucially exploits the fact that the cans that are to be cleaned are regularly held in place by a vacuum or in general by means of adhesion, as a result of which there is no risk of damage, not even with the respective lower strength of the walls of the cans. This is clearly different from the (overhead) internal cleaning of bottles. As is described for example in DE 10 2006 044 904 A1. Because in that case mechanical grippers are used that, even with thin PET bottles, can grasp the so-called neck ring without causing damage. But such procedures cannot be switched over to cans.

Thanks to the vacuum holding system, the cans are fixed in an entirely damage-free and problem-free manner and are able, in their overhead position, to be subjected to the described overhead inner cleaning without any problems. This is particularly effective because provision has been made for an axially moved or movable spraying unit with the nozzle located on its top side, so as to be able dispense the desired cleaning medium. A particularly effective internal cleaning is provided because the spraying unit, with its head-side located nozzle, travels in and out of the opening of the can. Any items left over from the production process are in this way removed from the inside of the cans. These procedures can obviously also be used in principle for cleaning the outside of the respective cans. All of this is achieved while having regard to a clearly reduced equipment-related expenditure and with, as a consequence, reduced costs compared with the state of the art, as described, for example, in JP 2002096807 A.

The invention is explained in more detail below using drawings that show an example of a design. In the drawings:

DETAILED DESCRIPTION

Figure 1:
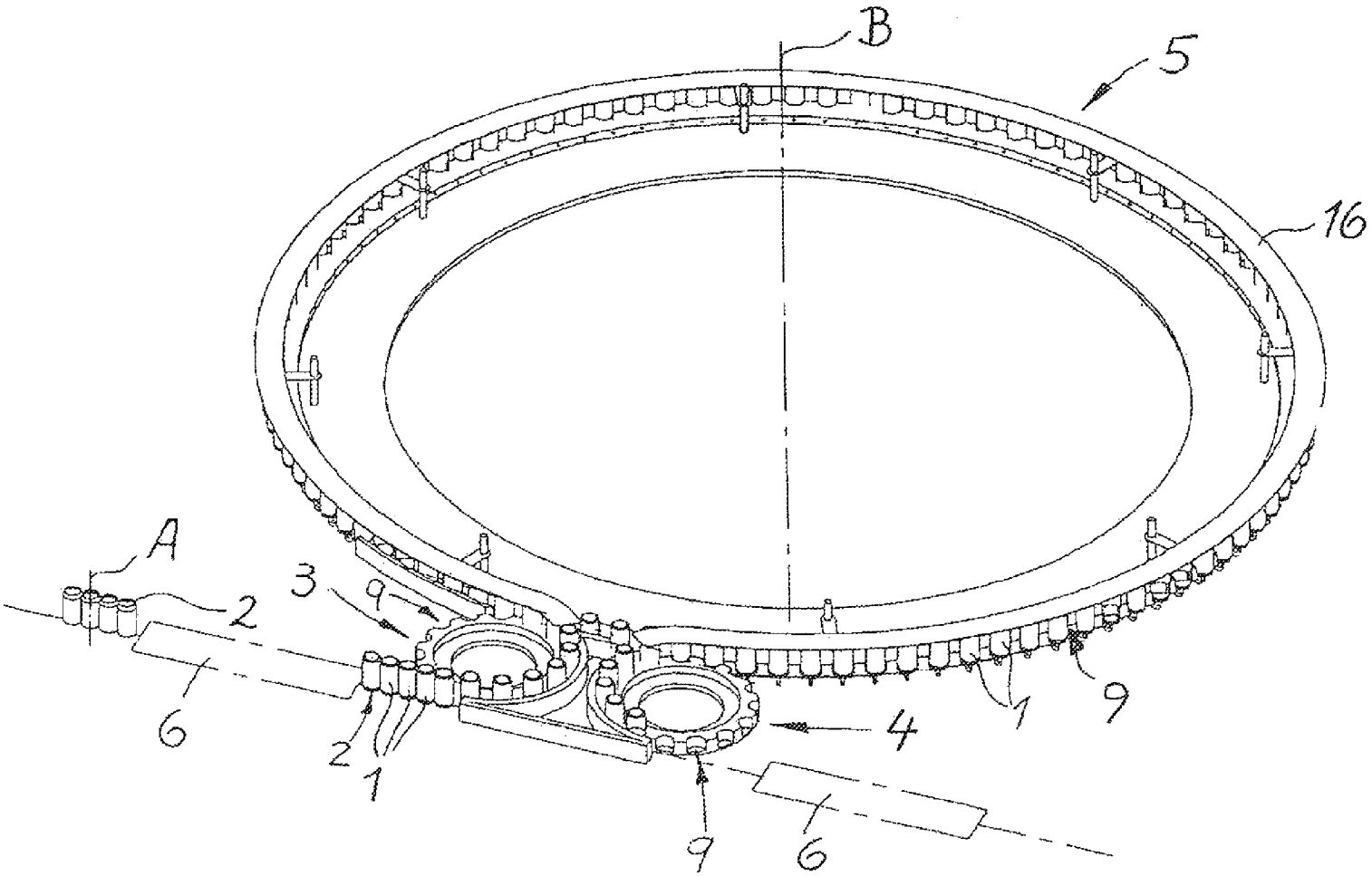
FIG. 1 shows an overhead view of a device for the overhead internal cleaning of cans.
Figure 2:
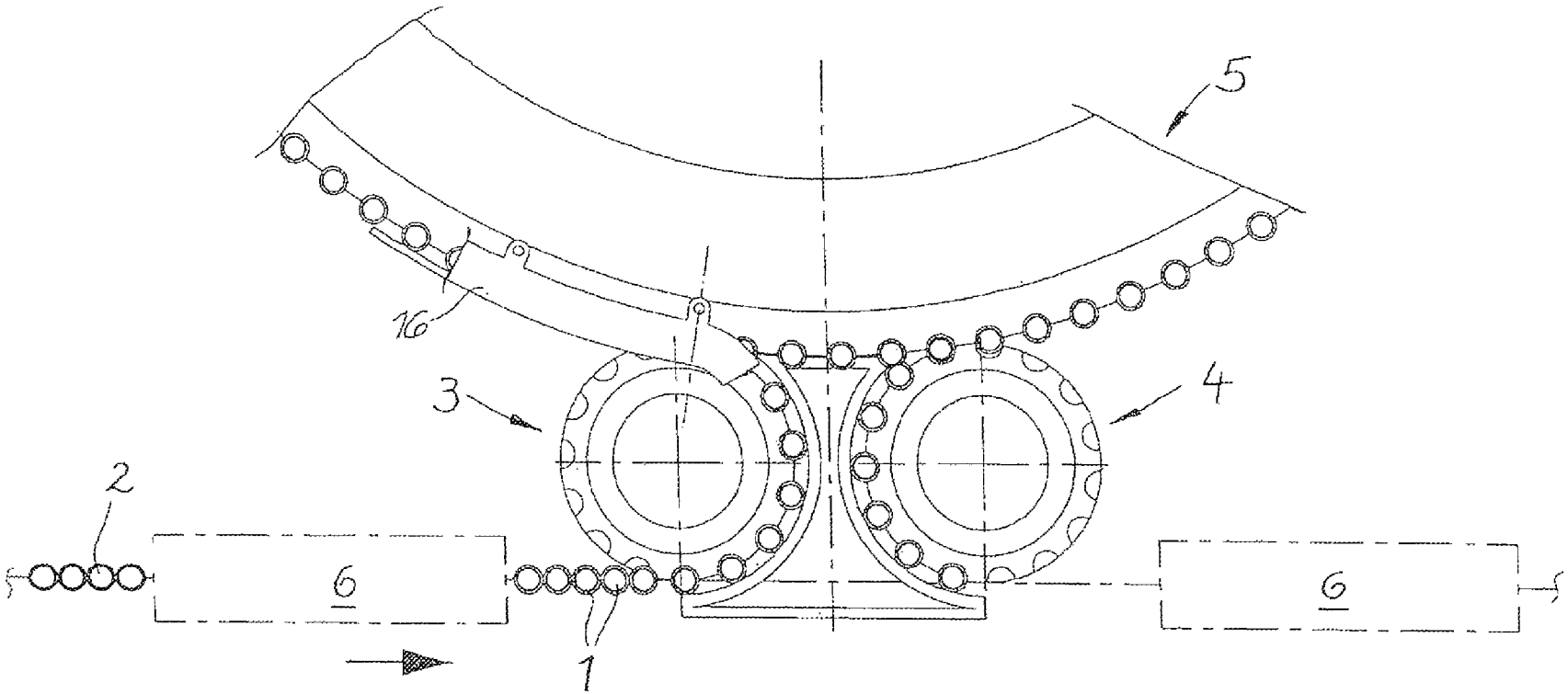
FIG. 2 shows a detailed cross-section of the device shown in FIG. 1.

A device for the handling and preferably for the cleaning of cans 1 with openings 2 is shown in the drawings. Reference is made here primarily to the internal cleaning of the cans 1, although an outside cleaning is also possible with the device and the processes that are still to be described. In terms of the cans 1, these relate in the example of the design and not restrictively to drink-cans normally made from sheet steel with a minimal wall thickness (<0.1 mm). The shape of the cans 1 is rotationally symmetrically in relation to an axis A so that the opening 2 is circular. That is not, however, essential. For example, octagonal or hexagonal cans with a correspondingly shaped opening can be processed.

Referring to FIG. 1, the illustrated device for overhead internal cleaning of the cans 1 has an in-feed conveyor 3 and an exit conveyor 4. The in-feed conveyor 3 transfers the cans 1 onto a circular conveyor or a concentric conveyor 5 or "carousel." A can-turning device 6 is inserted upstream of the in-feed conveyor 3 or an in-feed star installed at this point. A further can-turning device 6 is located downstream from the exit conveyor 4. A can-turning device 6 in front of the in-feed conveyor 3 transposes cans 1 that have been conveyed into this position in a filling position with an upwardly-pointing opening 2 into a subsequently assumed overhead position, in which the cans 1 reach the in-feed conveyor 3.

The cans 1 in the overhead position are then transferred from the in-feed conveyor 3 onto the curved conveyor or circular conveyor 5. The cans 1 at the exit of the circular conveyor 5 are channeled onto the exit conveyor 4 and from there into a further can-turning device 6. By means of this further can-turning device 6, the cans 1 are then transposed from the earlier assumed overhead position once again into the filling position. The cans are then ready to be filled with, for example, a $CO_2$-containing drink and to be sealed by application of a lid for sealing the opening 2. It is also possible to use a linear conveyor instead of a circular conveyor assisted by the in-feed conveyor 3, and the exit conveyor 4.

The in-feed conveyor 3, the exit conveyor 4, and the circular conveyor 5 have receptacles 9 on their respective circumferences in which the individual cans 1 are held and transported singly along the circular paths shown in FIG. 1. However, this is not essential because a linear conveyor could be used instead of the circular conveyor 5. The in-feed conveyor 3 and the exit conveyor 4 can be also linear-driven as described.

Figure 4:
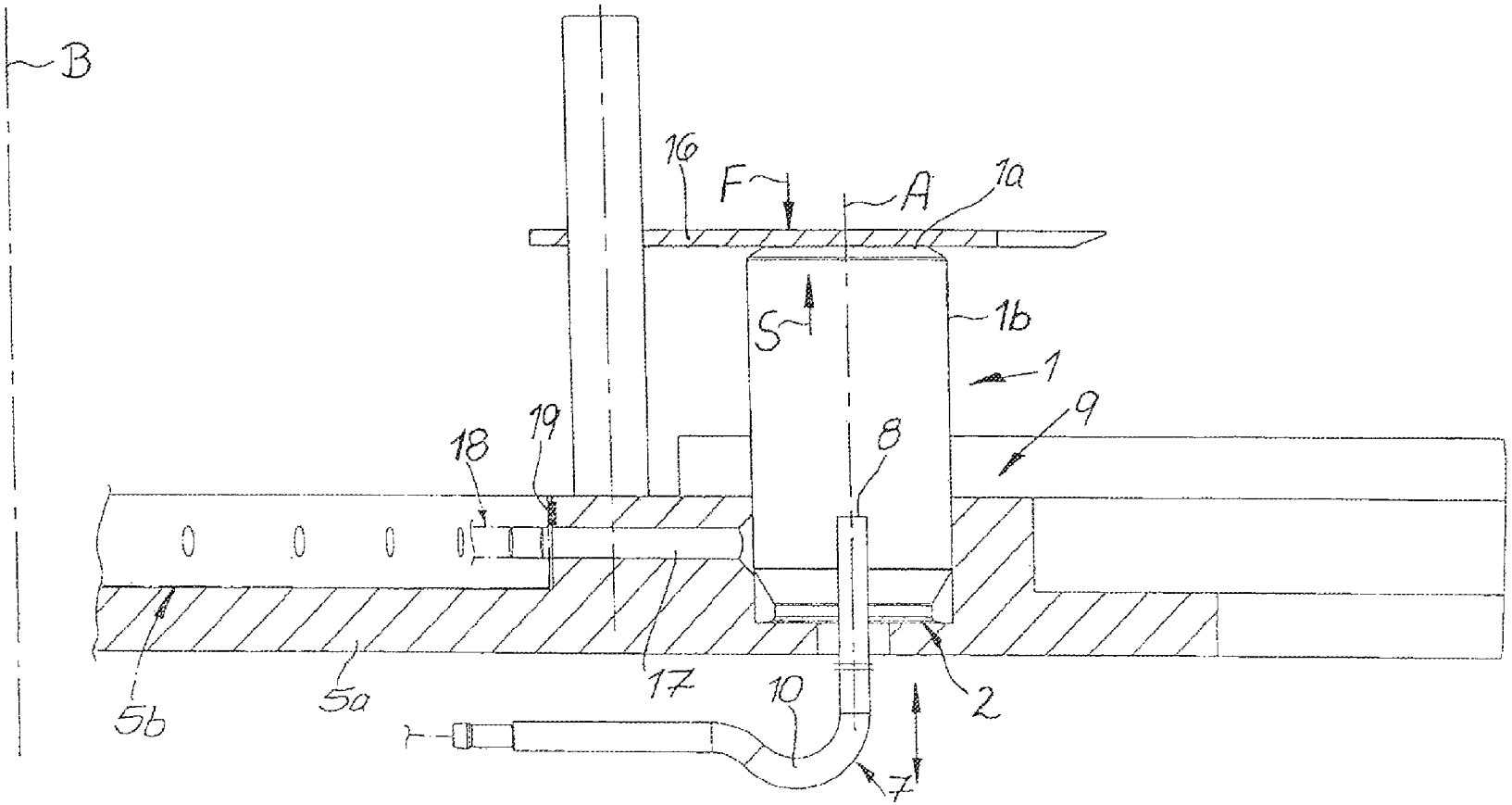
FIG. 4 is a detailed cross-section of the device holder shown in FIG. 3.

A spraying unit 7, best seen in FIG. 4 is fitted on its top side with a nozzle having a corresponding outlet 8 for dispensing a cleaning medium. Each individual can 1 or receptacle 9 of the circular conveyor 5 is allocated one individual spraying unit 7. The spraying unit 7 travels along a circular track together with the receptacle 9 or the can 1 that is placed into this receptacle 9 as the circular conveyor 5 revolves around its axis B, which is the axis/axle of the machine.

The circular conveyor 5, or a corresponding rotor 5*a*, which moves with respect to a fixed section 5*b* or stator of the circular conveyor 5 in the circular around the axis B, can be seen in FIG. 4. As part of the cleaning process, the spraying unit 7 and, jointly with the spraying unit 7, its outlet 8, moves in and out axially in relation to the axis A of the can 1, as indicated by a double-ended arrow in FIG. 4. For this purpose, every spraying unit 7 has its own drive or is moved along a prescribed mechanical curve.

In this way, the axially moving spraying units 7 can be inserted through the opening 2 into the can 1 for dispensing the cleaning medium. In this process, the outlet opening or nozzle 8 of the spray medium 7 is positioned centrally relative to the can 1, and moves axially on the axis A. As a result, the cleaning fluid that is dispensed, from the outlet opening of the nozzle 8 impacts the center of the can's base. Commencing from the base of the can 1*a* or starting from its center, the cleaning fluid spreads along the cylindrical walls 1*b* and eventually leaves, assisted by gravity, through the opening 2.

It can be seen that the individual cans 1 in the receptacle 9 of the circular conveyor or rotating conveyor 5 are held in place by negative pressure or through a vacuum that is created in the receptacles 9 or generally by adhesion. It is additionally clear from FIG. 4 that each spraying units 7 has a siphon 10 in its feed-line in order to prevent the ingress of contamination.

Figure 3:
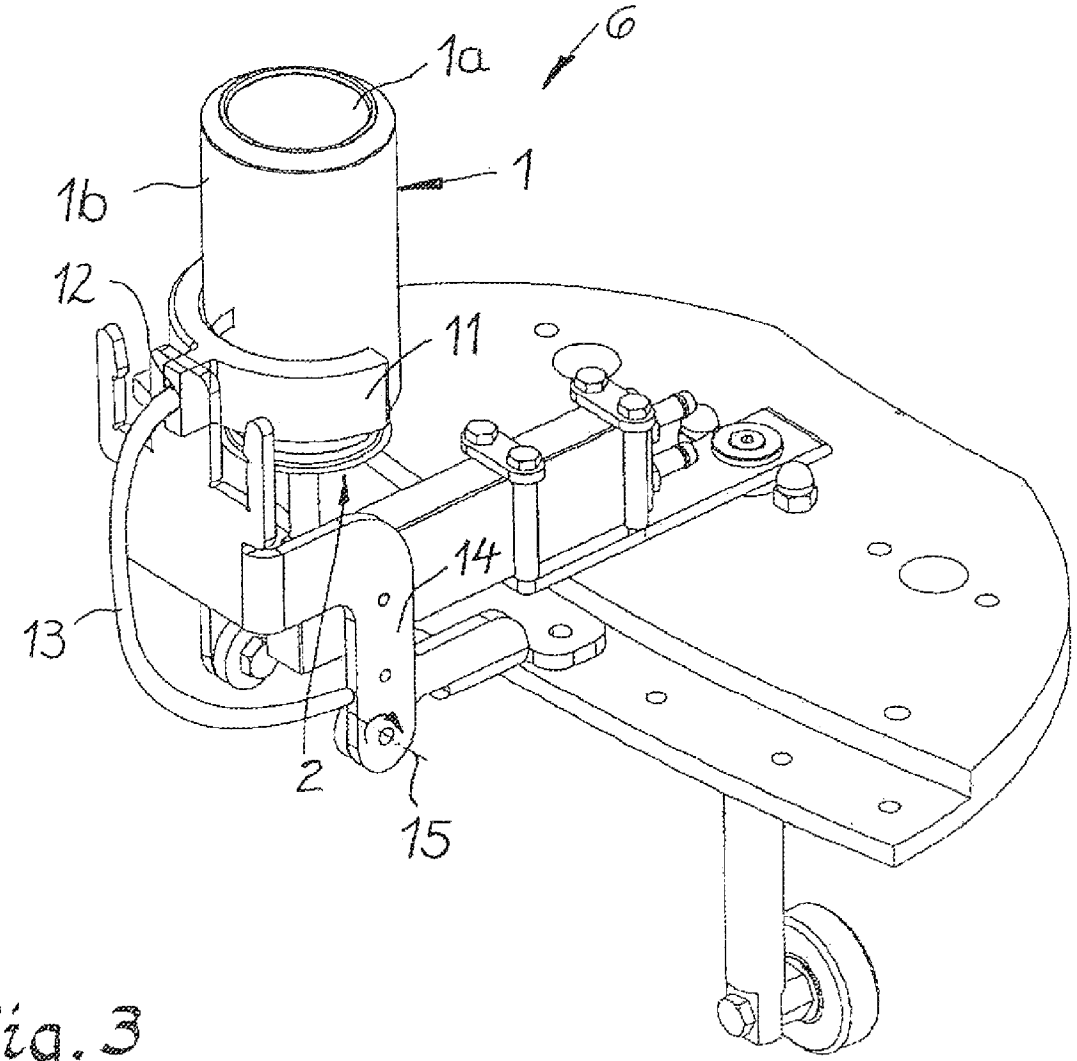
FIG. 3 shows a suction holder, as is used in the device shown in FIGS. 1 and 2.

FIG. 3 shows details of the structure of the can-turning device 6. In the embodiment of FIG. 3, a holder 11 grips and holds a can 1 in place. In general, the holder 11 can be an adhesive holder 11 or a suction holder 11.

As shown in FIG. 3, the holder 11 is shaped like an arc of a circle and at least partially surrounds the hollow cylindrical walls 1*b* of the can 1. A connection 12 connected to the line 13 supplies the holder 11 with negative pressure. Suction openings that are provided inside the suction holder 11 ensure that the can 1, with its walls 1*b*, is fixed within or onto the suction holder 11.

As shown in FIG. 3, the suction holder 11 is connected to a pivoting arm 14. This pivoting arm 14 enables the suction holder 11 to be pivoted around a horizontal axis 15, as indicated by the arrow in FIG. 3, thus turning the can 1. The pivoting arm 14 thus guides the can 1 out of its filling position, before the passing of the can-turning device 6 as shown in FIG. 1, into the overhead position that is illustrated in FIG. 3. This involves the suction holder 11 gripping the can walls 1*b* and the pivoting arm 14 swiveling around its axis 15 in the clockwise direction, as is shown in FIG. 3.

Instead of applying negative pressure or a vacuum to the suction openings, an adhesive such as, for example, water, can be exuded to fix the can 1. An alternative form of the can-turning device 6 thus operates in a comparable way. In this alternative, there is no suction holder 11 installed. Instead, an arch-shaped clamping gripper similar design engages the walls 1*b* of the can 1. This clamping gripper will look very much like the gripper shown in FIG. 3. The clamping gripper, like the suction holder 11, is also arch-shaped, and has a radius that corresponds essentially to that of the hollow cylindrical can 1.

The requisite adhesion between the can 1 and the clamping gripper is provided by the material from which the aforesaid clamping gripper is made. For example, the clamping gripper can be made by a flexible plastic material that has the necessary adhesion with the metal can 1, or by an adhesive, for example, a fluid such as water or oil, that is dispensed via openings that are present, in each case, in the inner sides of the clamping gripper. This fluid can be delivered by the line 13 and connection 12.

This adhesive provides the necessary adhesion of the can 1 with the clamping gripper. This embodiment foregoes the need for additional intervention with a vacuum or negative pressure.

As used herein, vacuum or negative pressure means a pressure that is less than the atmospheric pressure and that is sufficient and suitable to hold the can 1 in place.

Alternatively in this respect, as is described above, the operation can be performed with the flexible clamping gripper, and/or by resorting to an additional adhesive such as water or oil. These measures can also be combined.

As a result, the can 1 is positioned on the exit side of the can-turning device 6 in the overhead position illustrated in FIG. 3 such that it can then be transferred onto the in-feed conveyor 3, and from there, to the circular conveyor 5. The cleaning process described with reference to FIG. 4 is then carried out in this overhead position, as shown in FIG. 3. During the cleaning process, the can 1, in its overhead position, is subjected to a counterforce F, which is directed against a flushing force S. This is illustrated in FIG. 4.

The cleaning fluid that exits the nozzle 8 impacts the bases of the cans 1*a* with the flushing force S. The device has a bottom stop or a supporting arm 16 so that the can 1 is not pressed out of its receptacle 9 during this process. As a rule, each receptacle 9 is thus allocated a bottom stop or supporting arm 16.

It can be seen, from FIG. 1, that in the particular example, the bottom stop or supporting arm 16 extends over virtually the whole circumference of the circular conveyor 5. This bottom stop or supporting arm 16 ends, in each case, in the area in which the cans 1 are transferred in their overhead position from the in-feed conveyor 3 to the circular conveyor 5 or in the area in which the cans 1 are further transported, after their cleaning, from the circular conveyor 5 into the exit conveyor 4.

In conclusion, FIG. 4 again makes it clear that each receptacle 9 of the circular conveyor 5 is equipped with a suction connection or vacuum channel 17. The suction connection or vacuum channel 17 connects for its part with vacuum lines 18 that are located in the fixed section 5*b* or the stator 5*b* of the circular conveyor 5. When the rotor 5*a* is turning around the stator 5*b*, the respective vacuum line 18 is connected in predetermined angles of arc intervals to the suction connection or to the associated vacuum channel 17 so that the can 1 is held without any problems and by suction power in the associated receptacle 9 in its overhead position. An additional seal 19 ensures that the stator 5*b* is sealed against the rotor 5*a* and that the vacuum lead 18 can have a precisely targeted impact on the suction connection 17 or rather the vacuum channel 17 that is connected to it.

Instead of the suction connection 17 or the vacuum channel 17 that is connected to it, the receptacle 9 may also, as an alternative, be equipped with a suction holder 11 like the can-turning device 6 and vice versa. That is to say, the cans 1 are held in place in the respective receptacles 9 within the device that is illustrated by means of a vacuum that is generated or generally by adhesion. Alternatively, or in addition, the cans 1 can also be fixed in the receptacle 9 by comparable single or several clamping grippers, in the same way as has been described with reference to the can-turning device 6. In this case, an adhesive means/substance may then be fed, for example, via the vacuum channel 17 and in fact instead of the described alternative, in accordance with which the vacuum channel 17 is subjected to negative pressure. The recourse to just one or several flexible clamping grippers for the adhesive and damage-free fixing of the can 1 is possible also within the context of the receptacle 9.

All of these methods that have been described for holding the can 1 in place without damaging it can therefore be utilized for the respective can-turning devices 6, the in-feed conveyor 3, the exit conveyor 4 and the conveyor or circular conveyor 5 and indeed in summary both singly and cumulatively.

Having described the invention, and a preferred embodiment thereof, what we claim as new, and secured by Letters Patent is:

1. A process for internally cleaning inverted cans, each of said cans having a respective opening, said process comprising engaging a cylindrical wall of a can using a gripper that conforms to said cylindrical wall, said gripper being selected from a group consisting of a vacuum gripper and an adhesive gripper, causing an axially moving spraying unit for emission of a cleaning medium to travel in and out of said opening for internal cleaning of said can, cleaning said can by treating said can in an inverted position along a circular conveyor with said cleaning medium, wherein said spraying unit applies a flushing force to a base of said can, and subjecting said can to a counterforce to counter said flushing force, wherein subjecting said can to a counterforce comprises applying a counterforce with a supporting arm or bottom stop, thereby preventing said can from being pressed out of a receptacle in which said can is seated during cleaning.

2. The process of claim 1, further comprising guiding said can into said inverted position prior to internally cleaning said can.

3. The process of claim 1, further comprising conveying said can in the inverted position after internally cleaning said can.

4. The process of claim 2, further comprising turning said can, which is in the inverted position, into a filling position after internally cleaning said can.

5. The process of claim 1, further comprising, after internally cleaning said can, flushing said can with a gaseous pressurized sterilizing medium.

6. The process of claim 1, wherein said gripper is a vacuum gripper, said process further comprising creating a negative pressure to cause said vacuum gripper to engage said cylindrical wall.

7. The process of claim 1, wherein said gripper is an adhesive gripper, said process further comprising providing a surface of said adhesive gripper with a material that adheres to said cylindrical wall of said can with greater force than a metal would adhere to said cylindrical wall.

8. A process for internally cleaning an inverted can having an opening, said process comprising, using a clamping gripper on a wall of said can, wherein said gripper clamps said wall by applying a suction force to hold said can, causing an axially moving spraying unit to travel in and out of said opening for internal cleaning of said can, wherein said spraying unit emits a cleaning medium, and treating said can in an inverted position along a circular conveyor with said cleaning medium, wherein said cleaning medium causes a flushing force on said can, said process further comprising applying a counterforce to counter said flushing force, wherein applying said counterforce comprises applying a counterforce with a supporting arm or back stop, thereby preventing said can from being pressed out of a receptacle in which said can is seated during cleaning.

9. A process for internal cleaning an inverted can having an opening, said process comprising, using a clamping gripper on a wall of said can, wherein said gripper clamps said wall by applying an adhesive force to hold said can, causing an axially moving spraying unit to travel in and out of said opening for internal cleaning of said can, wherein said spraying unit emits a cleaning medium that exerts a flushing force on said can, and treating said can in an inverted position along a circular conveyor with said cleaning medium, said process further comprising applying a counterforce to counter said flushing force, wherein applying said counterforce comprises applying a counterforce with a supporting arm or back stop, thereby preventing said can from being pressed out of a receptacle in which said can is seated during cleaning.

* * * * *